US008373602B2

(12) United States Patent
Hsu

(10) Patent No.: US 8,373,602 B2
(45) Date of Patent: Feb. 12, 2013

(54) ANTENNA AND PORTABLE WIRELESS COMMUNICATION DEVICE USING THE SAME

(75) Inventor: Cho-Kang Hsu, Taipei (TW)

(73) Assignee: Chi Mei Communication Systems, Inc., Tu-Cheng, New Taipei (TW)

( * ) Notice: Subject to any disclaimer, the term of this patent is extended or adjusted under 35 U.S.C. 154(b) by 468 days.

(21) Appl. No.: 12/617,358

(22) Filed: Nov. 12, 2009

(65) Prior Publication Data

US 2010/0328165 A1 Dec. 30, 2010

(30) Foreign Application Priority Data

Jun. 25, 2009 (CN) ..... 2009 1 0303679

(51) Int. Cl.
*H01Q 1/38* (2006.01)
*H01Q 1/24* (2006.01)

(52) U.S. Cl. ..... 343/702; 343/700 MS

(58) Field of Classification Search ..... 343/700 MS, 343/702, 793, 795, 846
See application file for complete search history.

(56) References Cited

U.S. PATENT DOCUMENTS

| | | | | |
|---|---|---|---|---|
| 6,094,170 | A * | 7/2000 | Peng | 343/700 MS |
| 2008/0018539 | A1 * | 1/2008 | Jung et al. | 343/700 MS |
| 2010/0060526 | A1 * | 3/2010 | Cheng | 343/700 MS |

* cited by examiner

*Primary Examiner* — Robert Karacsony
(74) *Attorney, Agent, or Firm* — Altis Law Group, Inc.

(57) ABSTRACT

An antenna mounted on a baseboard including a first surface and a second surface opposite to the first surface includes a feed portion, two radiating portions, a ground portion and a coupling portion. The feed portion and the two radiating portions are disposed on the first surface, and the two radiating portions are connected to the feed portion. The ground portion and the coupling portion are disposed on the second surface, and the coupling portion is connected to the ground portion. The coupling portion passes through the baseboard and couples with two radiating portions.

11 Claims, 4 Drawing Sheets

ANTENNA AND PORTABLE WIRELESS COMMUNICATION DEVICE USING THE SAME

BACKGROUND

1. Technical Field

The disclosure generally relates to antennas, particularly to an antenna with wide frequency bandwidth and a portable wireless communication device using the antenna.

2. Description of Related Art

Antennas are important components of portable wireless communication devices such as mobile phones and personal digital assistants (). Typical portable wireless communication devices generally include a single frequency band antenna assembled therein to transmit and receive electromagnetic waves. The single frequency band antenna allows transmission and reception of only one frequency band for communication with no flexibility of using multiple frequency bands suitable for different communication systems such as digital video broadcasting (DVB) (470 MHz~800 Hz) and GSM (850/900/1800/1900 Hz). Theoretically, a different antenna for each frequency band can solve such problems. However, multiple antennas inevitably increase the cost of manufacturing portable wireless communication devices and occupy considerable space within portable wireless communication devices.

Therefore, there is room for improvement within the art.

BRIEF DESCRIPTION OF THE DRAWINGS

Many aspects of the antenna and portable wireless communication device can be better understood with reference to the following drawings. The components in the drawings are not necessarily drawn to scale, the emphasis instead being placed upon clearly illustrating the principles of the antenna and the portable wireless communication device.

DETAILED DESCRIPTION

Figure 1:
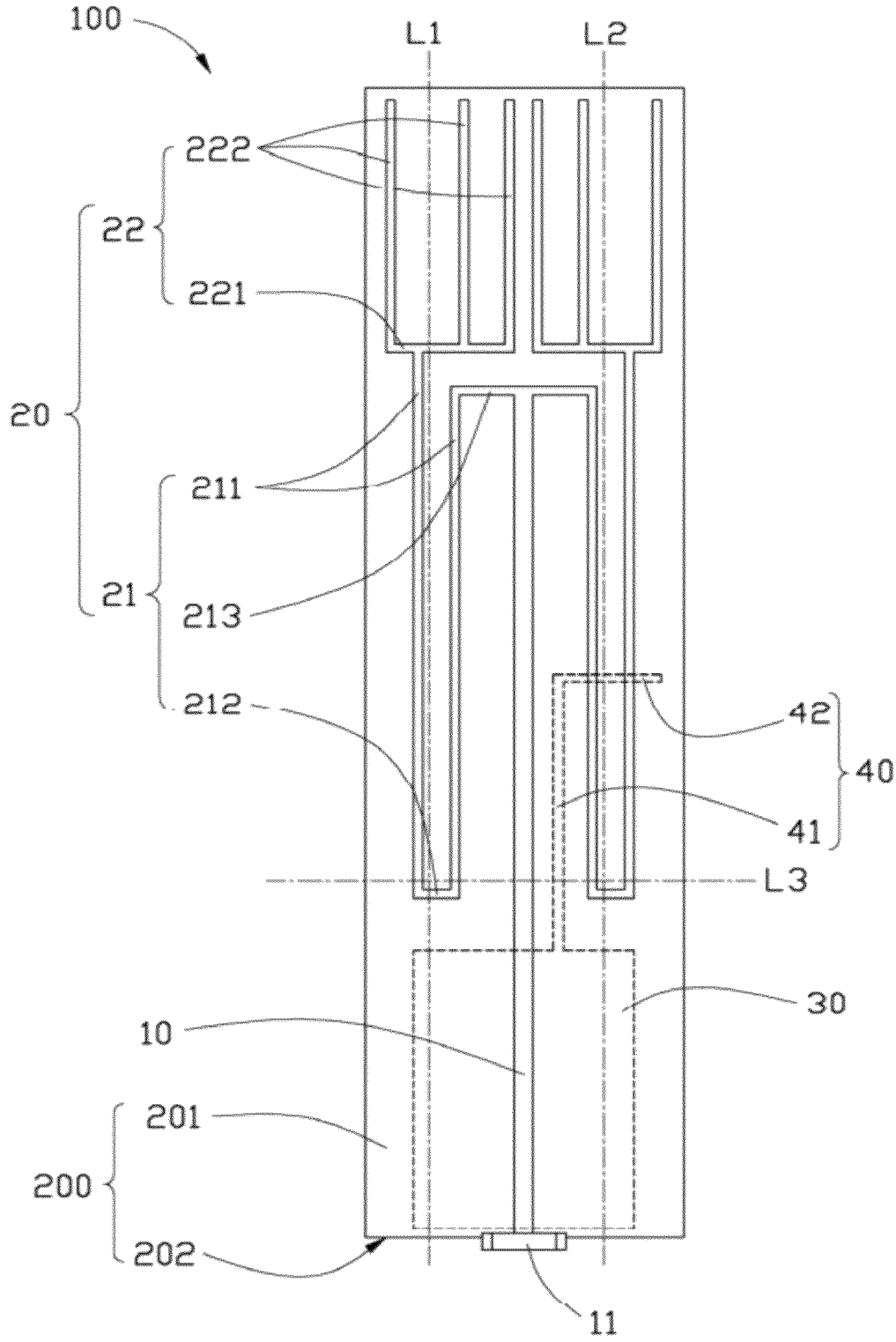
FIG. 1 is a schematic view of an antenna mounted on a baseboard, according to an exemplary embodiment.

Referring to FIG. 1, an antenna 100 is a double-sided printed antenna mounted on a baseboard 200 of a portable wireless communication device and includes a feed portion 10, two radiating portions 20, a ground portion 30, and a coupling portion 40.

The baseboard 200 is an approximately rectangular printed circuit board (PCB) mounted in the portable wireless communication device. The baseboard 200 includes a first surface 201 and a second surface 202 opposite thereto.

Figure 2:
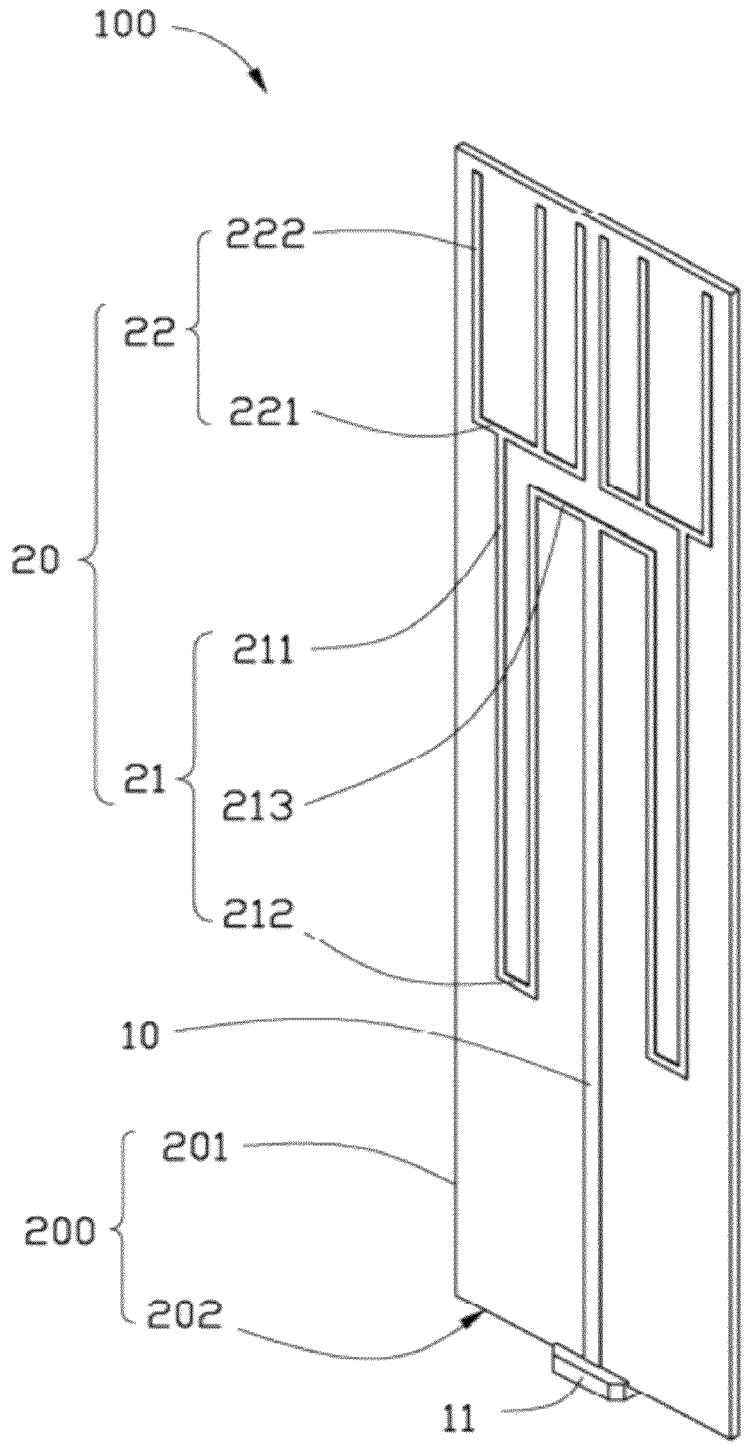
FIG. 2 is a schematic view of a portion of the antenna of FIG. 1, mounted on the first surface of the baseboard.

Referring to FIG. 2, the feed portion 10 is a longitudinal sheet disposed on the middle of the first surface 201 and perpendicular to an edge of the baseboard 200. A feed end 11 is set on the end of the feed portion 10 for receiving/transmitting signals from the baseboard 200.

Each of the two first radiating portions 20 includes a first radiating body 21 and a second radiating body 22 connected to the first radiating body 21. The first radiating body 21 includes two first band sections 211 and a second band section 212. Each first band section 211 is a longitudinal sheet. One end of each of the two first band sections 211 is connected perpendicular to two ends of the second band section 212, and the two first band sections 211 are parallel to each other. One end of one of first band sections 211 forms perpendicular angled portion 213, parallel to the second band section 212.

The second radiating body 22 includes a connecting arm 221 and three radiating arms 222. The connecting arm 221 and the radiating arms 222 are longitudinal sheets. Two of the radiating arms 222 are connected perpendicular to two ends of the connecting arm 221, the other radiating arm 222 is connected perpendicular to the connecting arm 221 between the other two radiating arms 222. The connecting arm 221 is connected perpendicular to the end of one first band section 211 opposite the second band section 212 at one side thereof, and forms one of the radiating portions 20. The two radiating portions 20 are symmetrically disposed on two sides of the feed portion 10 with the two angled portions 213 connected perpendicular to one end of the feed portion 10.

Figure 3:
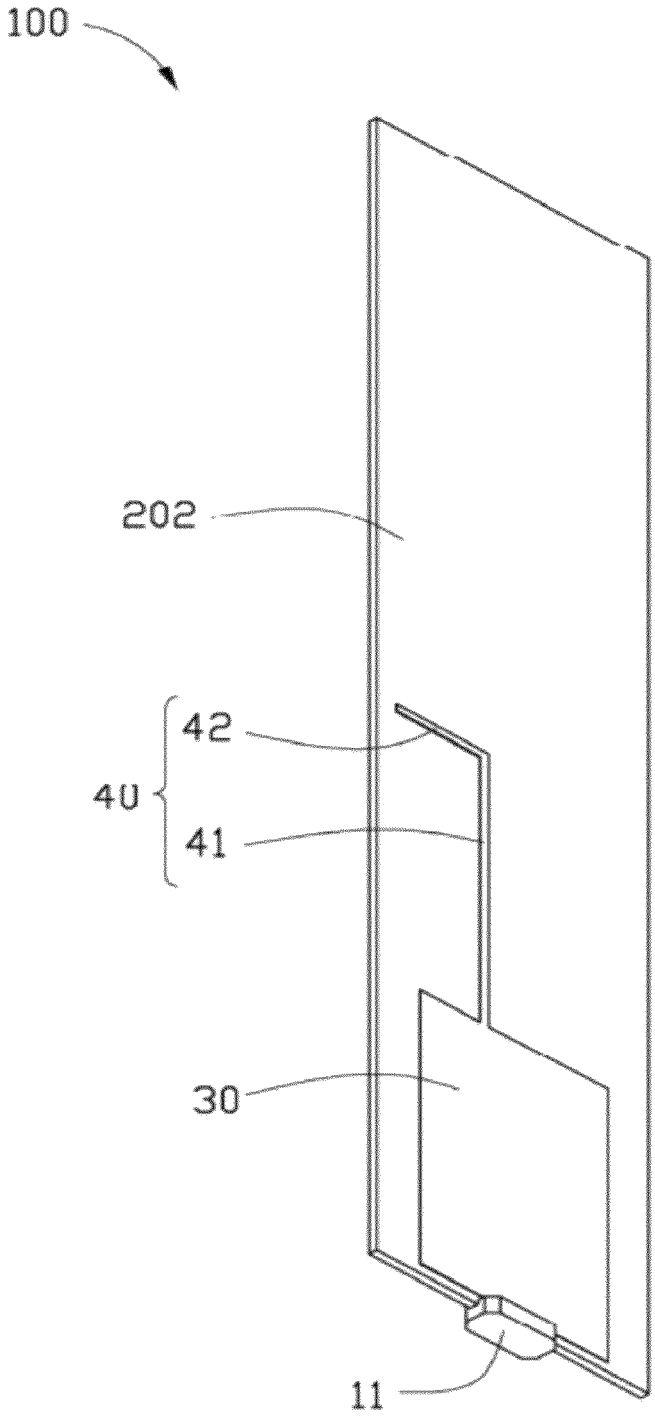
FIG. 3 is a schematic view of a portion of the antenna of FIG. 1, mounted on the second surface of the baseboard.

Referring to FIG. 3, the ground portion 30 is substantially a rectangular sheet disposed on the second surface 202 of the baseboard 200. The ground portion 30 is connected to the coupling portion 40.

The coupling portion 40 is disposed on the second surface 202 of the baseboard 200 connected perpendicular to the ground portion 30 on one side thereof. The coupling portion 40 is approximately an L-shaped sheet including a first coupling portion 41 and a second coupling portion 42 connected perpendicular to the first coupling portion 41. One end of the first coupling portion 41 opposite to the second coupling portion 42 is connected perpendicular to an edge of the ground portion 30. The coupling portion 40 passes through the baseboard 200 and couples with the two radiating portions 20 to enhance the signal radiation, and obtain a wide frequency bandwidth.

Figure 4:
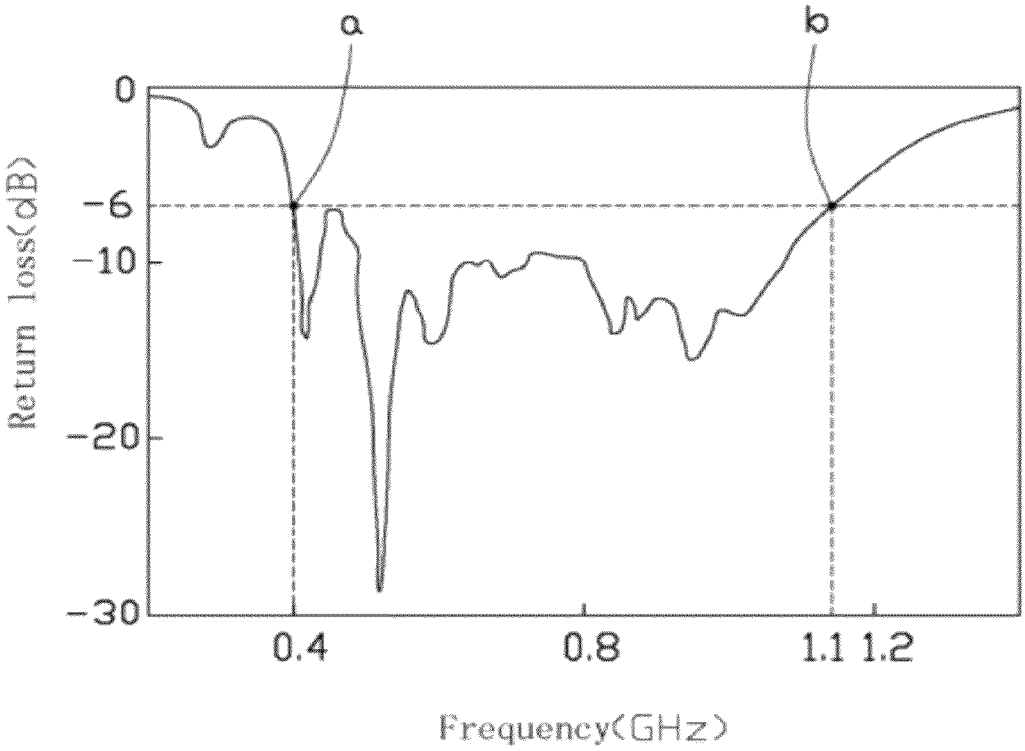
FIG. 4 is an exemplary test graph obtained from the antenna of FIG. 1, disclosing return loss varying with frequency.

Referring to FIG. 4, during a test of an exemplary antenna 100, the antenna 100 was shown to be suitable for working at frequency bandwidth from 400 MHz to 1100 MHz, which covers the DVB frequency band (470 MHz~800 Hz), and portion of GSM frequency band (850/900 MHz). In other embodiments, the space between the three radiating arms 222 can be changed to adjust the working frequency bandwidth of the antenna 100.

Referring to FIG. 1, the baseboard 200 may be made of flexible material, flexible along one or more of lines L1, L2, or L3 to reduce space occupied within a portable wireless communication device.

The antenna 100 is planar and flexible, and occupies minimal space within the portable wireless communication device. Furthermore, the antenna 100 obtains a wide frequency bandwidth via two radiating portions 20 disposed on the first surface 201 and coupler portion 40 disposed on the second surface 202.

It is believed that the exemplary embodiments and their advantages will be understood from the foregoing description, and it will be apparent that various changes may be made thereto without departing from the spirit and scope of the invention or sacrificing all of its material advantages, the examples hereinbefore described merely being preferred or exemplary embodiments of the invention.

What is claimed is:

1. An antenna mounted on a baseboard including a first surface and a second surface opposite to the first surface, the antenna comprising:

a feed portion disposed on the first surface;

two radiating portions disposed on the first surface, and connected to the feed portion, and each radiating portion comprising a first radiating body connected to one end of the feed portion and a second radiating body, the second radiating body connected to the feed portion through the first radiating body on the first surface;

a ground portion disposed on the second surface; and a coupling portion disposed on the second surface, and connected to the ground portion on the second surface; wherein the coupling portion couples with the two radiating portions on the first surface, the two radiating portions are symmetrically disposed on two sides of the feed portion, the first radiating body includes two first band sections and a second band section, one end of the two first band sections is connected perpendicular to two ends of the second band section, and one end of one of the first band sections forms an angled portion connected to the feed portion, the second radiating body includes a connecting arm and three radiating arms, two of the radiating arms are connected perpendicular to two ends of the connecting arm, the other radiating arm is connected perpendicular to the connecting arm between the two radiating arms.

2. The antenna as claimed in claim 1, wherein the feed portion is a longitudinal sheet with a feed end at one end thereof.

3. The antenna as claimed in claim 1, wherein the ground portion is approximately a rectangular sheet.

4. The antenna as claimed in claim 1, wherein the coupling portion is approximately an L-shaped sheet and includes a first coupling portion and a second coupling portion, the second coupling portion is connected perpendicular to the first coupling portion, and one end of the first coupling portion opposite to the second coupling portion is connected perpendicular to an edge of the ground portion.

5. The antenna as claimed in claim 1, wherein the connecting arm is connected perpendicular to the end of one first band section opposite the second band section at one side thereof, and forms one of the radiating portion.

6. A portable wireless communication device, comprising:

a baseboard including a first surface and a second surface opposite to the first surface; and an antenna mounted on the baseboard, the antenna comprising:

a feed portion disposed on the first surface;

two radiating portions disposed on the first surface, and connected to the feed portion, and each radiating portion comprising a first radiating body connected to one end of the feed portion and a second radiating body, the second radiating body connected to the feed portion through the first radiating body on the first surface;

a ground portion disposed on the second surface; and a coupling portion disposed on the second surface, and connected to the ground portion on the second surface; wherein the coupling portion couples with the two radiating portions on the first surface, the two radiating portions are symmetrically disposed on two sides of the feed portion, the first radiating body includes two first band sections and a second band section, one end of the two first band sections is connected perpendicular to two ends of the second band section, one end of one of the first band sections forms an angled portion connected to the feed portion, the second radiating body includes a connecting arm and three radiating arms, two of the radiating arms are connected perpendicular to two ends of the connecting arm, and the other radiating arm is connected perpendicular to the connecting arm between the two radiating arms.

7. The portable wireless communication device as claimed in claim 6, wherein the feed portion is a strip with a feed end at one end thereof.

8. The portable wireless communication device as claimed in claim 6, wherein the ground portion is approximately a rectangular sheet.

9. The portable wireless communication device as claimed in claim 6, wherein the coupling portion is approximately an L-shaped sheet and includes a first coupling portion and a second coupling portion, the second coupling portion is connected perpendicular to the first coupling portion, and one end of the first coupling portion opposite to the second coupling portion is connected perpendicular to an edge of the ground portion.

10. The portable wireless communication device as claimed in claim 6, wherein the baseboard is made of flexible material.

11. The portable wireless communication device as claimed in claim 6, wherein the connecting arm is connected perpendicular to the end of one first band section opposite the second band section at one side thereof, and forms one of the radiating portion.

* * * * *